US008043141B1

(12) United States Patent
Goff

(10) Patent No.: US 8,043,141 B1
(45) Date of Patent: Oct. 25, 2011

(54) THROWING WHEEL ASSEMBLY

(76) Inventor: James R. Goff, Coweta, OK (US)

( * ) Notice: Subject to any disclaimer, the term of this patent is extended or adjusted under 35 U.S.C. 154(b) by 495 days.

(21) Appl. No.: 12/356,748

(22) Filed: Jan. 21, 2009

(51) Int. Cl.
*B24C 5/06* (2006.01)

(52) U.S. Cl. ..... 451/97; 451/38; 451/98

(58) Field of Classification Search ..... 451/38, 451/91, 94, 95, 97, 98; 241/5, 275; 416/236 R, 416/246
See application file for complete search history.

(56) References Cited

U.S. PATENT DOCUMENTS

| | | | | |
|---|---|---|---|---|
| 2,819,562 | A * | 1/1958 | Barnes | 451/97 |
| 3,197,920 | A * | 8/1965 | Moore et al. | 451/97 |
| 3,241,266 | A * | 3/1966 | Bowling, Jr. | 451/97 |
| 3,352,064 | A * | 11/1967 | De Groot et al. | 451/97 |
| 3,383,804 | A * | 5/1968 | Haider | 451/97 |
| 3,654,736 | A * | 4/1972 | De Groot | 451/97 |
| 3,894,360 | A * | 7/1975 | DeGroot et al. | 451/98 |
| 4,471,583 | A * | 9/1984 | Carpenter et al. | 451/97 |
| 4,941,297 | A * | 7/1990 | Carpenter | 451/97 |
| 5,081,801 | A * | 1/1992 | Fylak | 451/97 |
| 5,888,125 | A * | 3/1999 | Kuehn | 451/95 |
| 6,981,910 | B1 * | 1/2006 | Goff | 451/91 |
| 7,311,584 | B2 * | 12/2007 | Goff | 451/38 |
| 7,585,207 | B2 * | 9/2009 | Barriger | 451/97 |

* cited by examiner

*Primary Examiner* — George Nguyen
(74) *Attorney, Agent, or Firm* — Fellers, Snider, Blankenship, Bailey & Tippens, P.C.; Dennis D. Brown

(57) ABSTRACT

An abrasive throwing wheel assembly comprising a rotating wheel having a forward face including: a recess bounded circumferentially by an interior wall of a forward peripheral portion; a plurality of blade slots in the forward peripheral portion; and a groove, for receiving a retaining element, provided in the recess proximate the rearward base end of the interior wall. To prevent the retaining element groove from interfering with the attachment and removal of the blades, the assembly also includes: (a) the peripheral portion having a rearwardly sloped forward surface, (b) the interior wall diverging rearwardly toward the axis of rotation, and/or (c) the blade slots extending outwardly from the recess at a rearward angle.

17 Claims, 5 Drawing Sheets

THROWING WHEEL ASSEMBLY

FIELD OF THE INVENTION

The present invention relates to throwing wheel assemblies for abrasive blasting machines.

BACKGROUND OF THE INVENTION

Centrifugal blasting machines are commonly used for stripping or cleaning floors, storage tank walls, metal castings, and other items. Some machines employ a throwing wheel assembly comprising a plurality of throwing blades mounted on only the front face of a single plate-type rotor, runner head, or other single plate wheel element. Other designs utilize wheels having a pair of opposing plates (i.e., a front plate and a back plate) between which the throwing blades are mounted. Although the single plate and double plate designs all have limited service lives, the single plate-type wheel designs are preferred by many in the art because they are simpler and much less costly to manufacture, balance, and replace.

The blasting machine throwing blades are adapted for receiving a stream of steel shot, hardened steel grit, other abrasive material, or a combination thereof and throwing the abrasive material radially outward from the wheel at an appropriate discharge point. Different treatment profiles can be provided by varying the type or mix ratio of the abrasive material, varying the abrasive size, and/or adjusting the rotating speed of the throwing wheel assembly. The abrasive material cleans the surface of the floor, wall or other item and typically rebounds, along with removed contaminants, dust, and debris, into a separator or other recovery chamber. Unfortunately, because of the action of the abrasive material within the centrifugal blasting apparatus, the throwing blades undergo considerable wear and must be replaced periodically.

In one common type of blasting assembly, the throwing wheel, throwing blades, and the rotating central impeller of the device are all cast in place as a unitary structure. Although such unitary cast structures do not require further assembly and do not present blade retention concerns during installation, they have significant shortcomings and disadvantages. For example, although the throwing wheel and other portions of the unitary cast structure are less susceptible to wear and damage than are the throwing blades, the entire cast structure must be replaced when the blades are worn, or if even just a single blade is chipped or broken. In addition, the unitary casting procedure does not allow the blade portion of the casting to be formed from a different, harder, more wear-resistant material. Further, the use of a harder, more wear-resistant material for forming the entire structure is not practical due to both higher cost and the poor casting characteristics of these harder materials which, for example, make them much more difficult to machine after heat treatment.

To address these issues, and to obtain the benefits of a single plate design, various efforts have been made to develop throwing assemblies wherein the throwing blades are removably mounted on the forward face of a single plate-type throwing wheel. One such throwing wheel assembly is described in U.S. Pat. No. 7,311,584, the entire disclosure of which is incorporated by reference. The prior art assembly comprises; a single plate throwing wheel; a hub affixed to the back of the throwing wheel; a plurality of throwing blades which are removably mount on, and are perpendicular to, the forward face of the throwing wheel; and an impeller centrally mounted on the hub between the inlet ends of the throwing blades. The blades generally extend radially away from the impeller.

As is generally the case, the impeller rotates with the throwing wheel for receiving a stream of abrasive blasting material from a spout and feeding the abrasive material to the throwing blades. The rotating impeller delivers the abrasive material through the discharge opening of a stationary control cage within which the impeller is rotatably positioned. The abrasive material is received on the inlet ends of the blades as the blades rotate past the cage opening. The abrasive material then moves outwardly along the throwing surfaces of the blades and is thrown from the distal ends of the blade throwing surfaces at a desired discharge point.

In the single plate throwing assembly described in U.S. Pat. No. 7,311,584, each of the throwing blades has a holding structure which projects laterally outward from the lower end of the rearwardly facing side edge of the blade. This lower holding structure is configured for removable, locking engagement with a corresponding retaining slot formed in the wheel face. Consequently, during operation, the centrifugal force exerted by the rotation of the throwing wheel operates to continuously urge the blades radially outward into secure engagement with the holding slots formed in the wheel face. However, in removable blade systems such as this when the system is being assembled and installed and there is no centrifugal force acting against the blades, additional retaining mechanisms are needed to at least temporarily hold the blades in place so that they do not fall off the wheel face.

To deal with this problem, U.S. Pat. No. 7,311,584 discloses the addition of a second (upper) holding structure to the side edge of each blade. These upper holding structures are received in peripheral detents formed around the throwing wheel wherein they are contacted with individual biasing springs. The biasing springs operate to continuously urge the throwing blades radially outward such that the lower blade holding structures are always held in locked engagement in the blade retaining slots.

As will be understood by those in the art, a continuing need exists for improved single plate rotating wheel assemblies having removable throwing blades. A need particularly exists for improved assemblies of this type which (a) are lower in cost, (b) are less complicated to assemble, install, and remove, (c) are easier to manufacture, and (d) provide a much simpler yet highly effective means for retaining the removable blades on the throwing wheel during assembly and installation procedures.

SUMMARY OF THE INVENTION

The present invention satisfies the need and alleviates the problems discussed above. In one aspect, there is provided an improved throwing apparatus of the type comprising a rotatable wheel and a plurality of throwing blades positionable on a forward face thereof, the rotatable wheel having an axis of rotation and each of the throwing blades having a holding structure projecting therefrom. The improvement comprises: (a) the forward face of the rotatable wheel including a recess surrounded by a forward peripheral portion of the forward face such that at least a portion of the recess is bounded circumferentially by an axially extending interior wall of the forward peripheral portion; (b) a blade retainer groove provided in the recess of the forward face proximate a rearward end of the interior wall for removably receiving a blade retainer; (c) a plurality of slots extending through the interior wall and outwardly into the forward peripheral portion away from the recess for removably receiving the holding structures of the throwing blades; and (d) the forward peripheral portion comprising a forward peripheral face surface which extends outwardly away from the recess at a rearward angle effective to allow the holding structures of the throwing blades to be delivered into and removed from the slots without interference from the blade retainer groove.

In another aspect, there is provide an improved apparatus for throwing an abrasive material, the apparatus being of a type comprising a rotatable wheel and a plurality of throwing blades positionable on a forward face of the rotatable wheel, the rotatable wheel having an axis of rotation and each of the blades having a holding structure projecting therefrom. The improvement comprises: (a) the forward face of the rotatable wheel including a recess surrounded by a forward peripheral portion of the forward face such that at least a portion of the recess is bounded circumferentially by an axial extending interior wall of the forward peripheral portion; (b) a blade retainer groove provided in the recess of the forward face proximate a rearward end of the interior wall for removably receiving a blade retainer; (c) a plurality of slots extending through the interior wall and outwardly into the forward peripheral portion away from the recess for receiving the holding structures of the throwing blades; and (d) the slots extending outwardly away from the recess at a rearward angle effective to allow the holding structures of the throwing blades to be delivered into and removed from the slots without interference from the blade retainer groove. Preferably, the holding structures are also configured such that, when the holding structures are received in the slots, the holding structures will extend outwardly away from the recess at a rearward angle corresponding to the rearward angle of the slots.

In another aspect, there is provided an improved apparatus for throwing an abrasive material, the apparatus being of the type comprising a rotatable wheel, a plurality of throwing blades positionable on a forward face of the rotatable wheel, an impeller for delivering the abrasive material to the blades, a drive shaft, and a hub positionable on a rearward side of the rotatable wheel. The improvement comprises: (a) the impeller having a locking structure which extends rearwardly from the impeller; (b) the locking structure being receivable in a corresponding locking slot provided in the recess of the forward face of the rotatable wheel; (c) the locking structure and the corresponding locking slot being configured in a manner effective for causing the impeller and the rotatable wheel to rotate together; (d) the drive shaft being receivable in an aperture provided in the hub in a keyed engagement with the hub such that the hub will be caused to rotate with the drive shaft; and (e) the impeller being attachable to the drive shaft by inserting a bolt rearwardly through a longitudinal bore in the locking structure and threading the bolt into a threaded aperture provided in a forward end of the drive shaft.

Further aspects, features, and advantages of the present invention will be apparent to those of ordinary skill in the art upon examining the accompanying drawings and upon reading the following detailed description of the preferred embodiments.

DETAILED DESCRIPTION OF THE PREFERRED EMBODIMENTS

Figure 1:
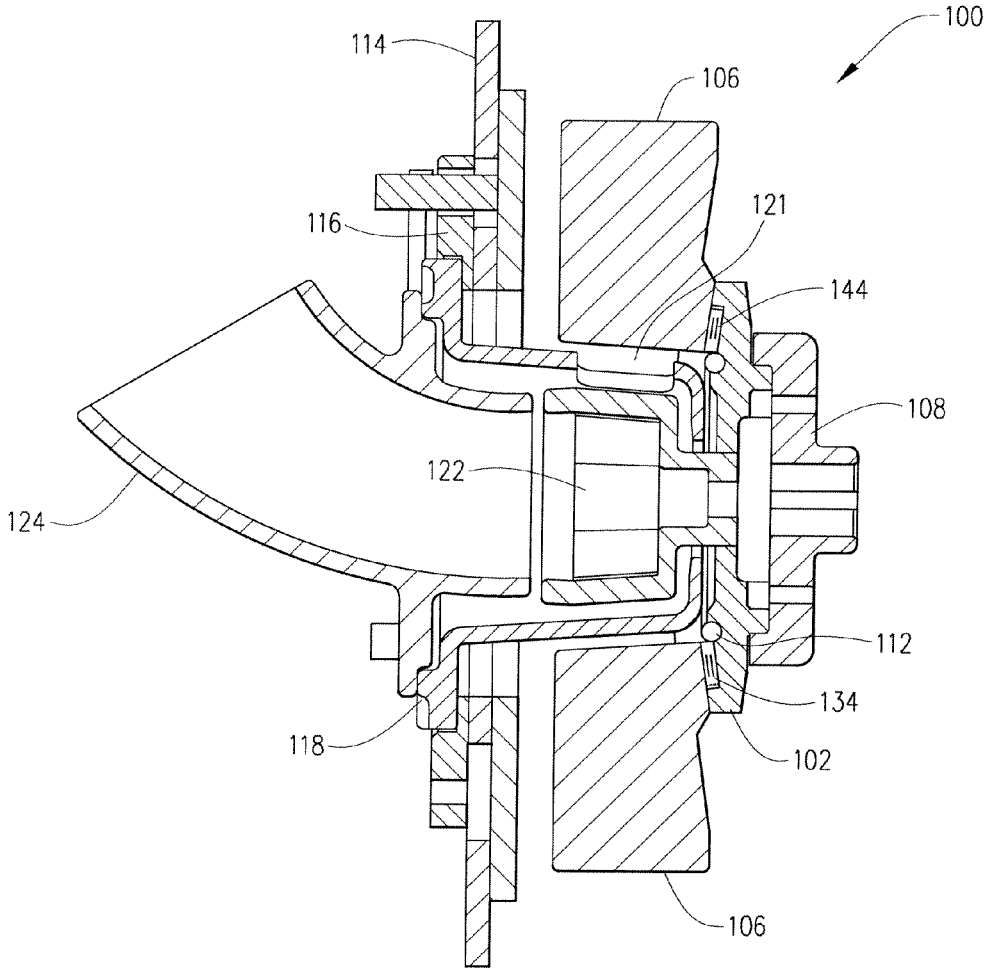
FIG. 1 is a cutaway elevational side view of an embodiment 100 of the inventive throwing wheel assembly.
Figure 2:
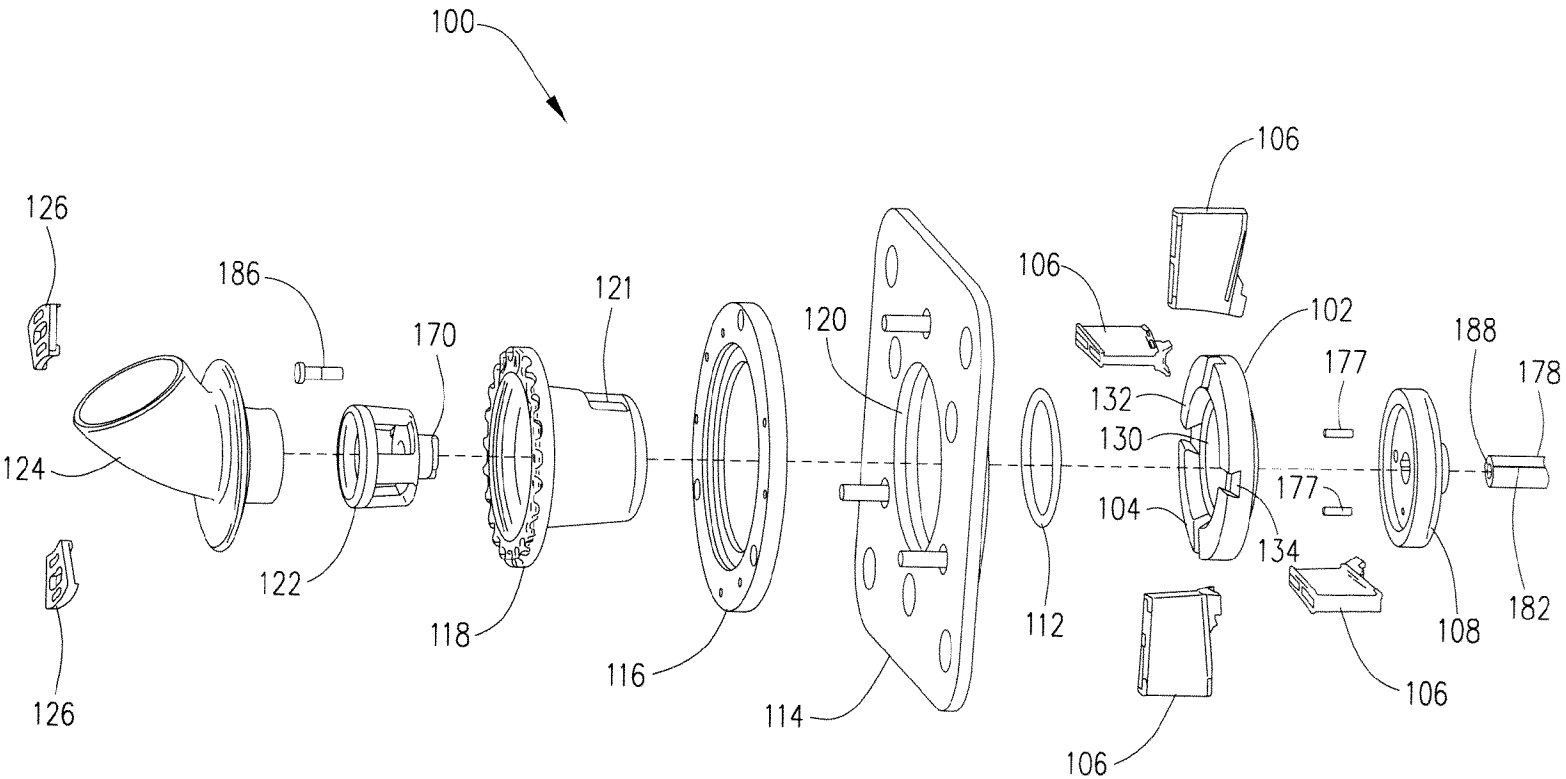
FIG. 2 is an exploded view of the throwing wheel assembly 100.
Figure 4:
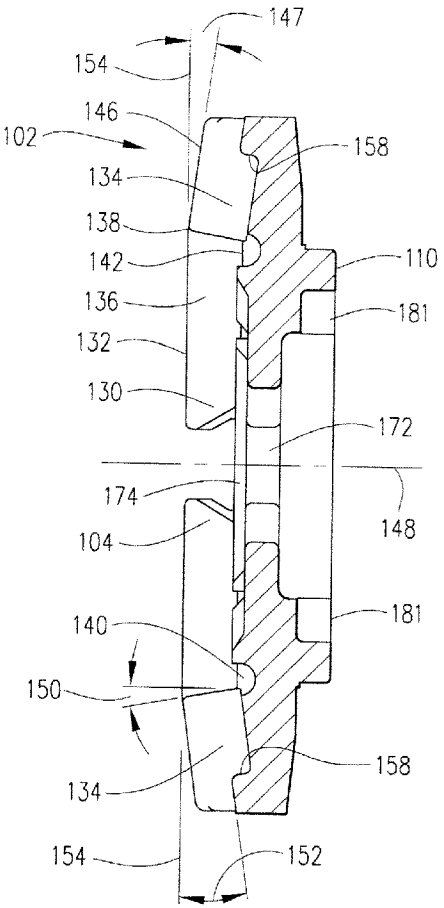
FIG. 4 is a cutaway side elevational view of the rotating wheel 102.
Figure 3:
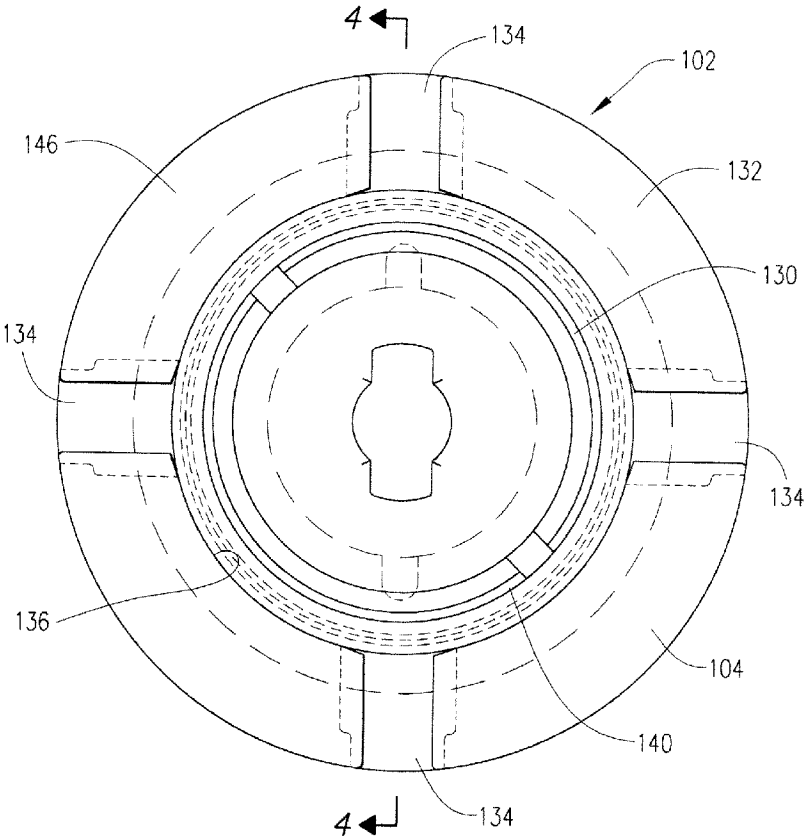
FIG. 3 is a front elevational view of a single plate-type rotating wheel 102 used in the inventive assembly 100.
Figure 5:
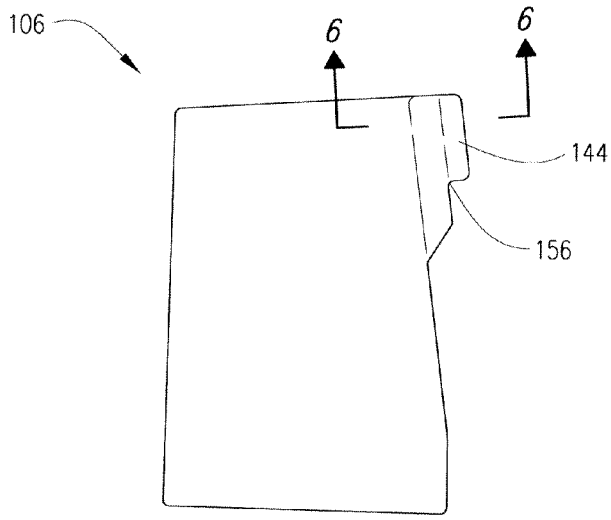
FIG. 5 is a front elevational view of a throwing blade 106 used in the inventive assembly 100.
Figure 6:
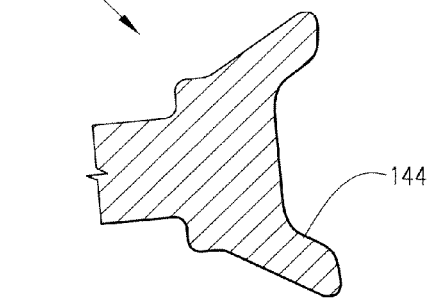
FIG. 6 is a cutaway cross-sectional view of the holding structure 144 of the throwing blade 106.
Figure 7:
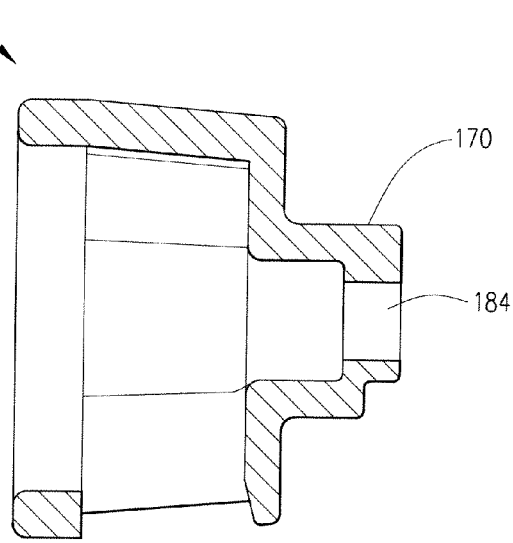
FIG. 7 is a cutaway elevational side view of an impeller 122 used in the inventive assembly 100.
Figure 8:
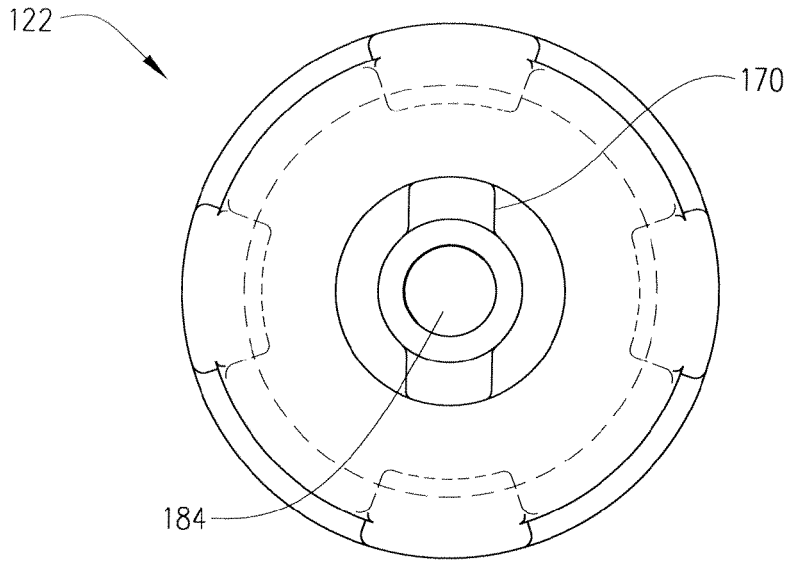
FIG. 8 is an elevational rear view of the impeller 122.
Figure 9:
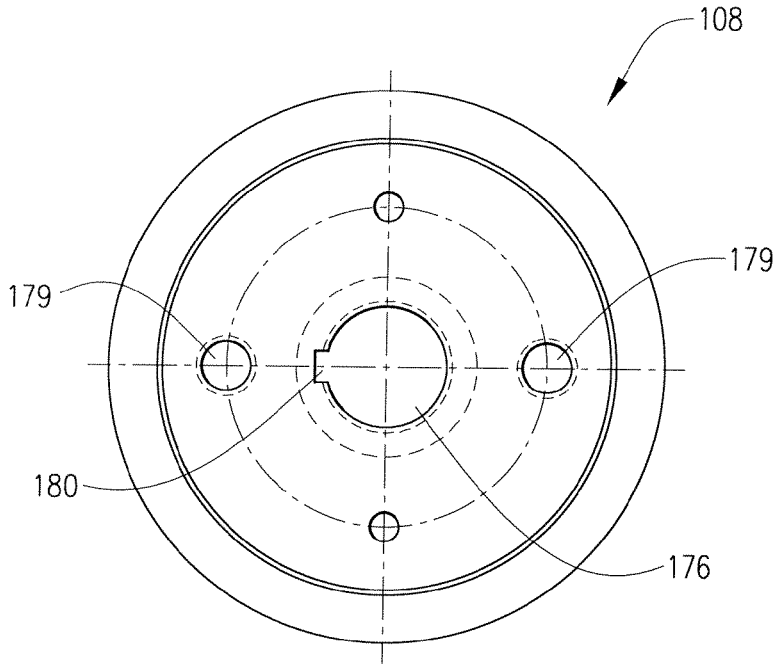
FIG. 9 is an elevational front view of a hub 108 used in the inventive assembly 100.

An embodiment 100 of the inventive throwing wheel assembly is depicted in FIGS. 1-9. The inventive assembly 100 comprises: a single plate throwing wheel 102 having a forward face 104; a plurality of throwing blades 106 which are removably positionable on the wheel face 104; an assembly hub 108 which is positioned on the rearward side 110 of the rotating wheel 102; an O-ring or other retainer 112 for preventing the throwing blades 106 from falling off of the wheel face 104 during installation; a mounting plate 114 which forms a part of the housing of the blasting system for aligning and securing the various components of the inventive assembly 100; a control cage adaptor 116 which is installed on the forward face of the mounting plate 114; an adjustable control cage 118 which extends through a central aperture 120 of the mounting plate 114 and includes a side discharge opening 121 for controlling the point of delivery of the abrasive material to the inlet ends of the throwing blades 106; an impeller 122 which rotates with the throwing wheel 102 and blades 106 for directing and pre-accelerating the material through the control cage opening 121 and onto the rotating blades 106; a gravity feed spout 124 which extends into the forward end of the control cage 118 for delivering the abrasive material to the rotating impeller 122; and a plurality of locking clamps 126 for adjustably locking the control cage 118 in generally any operating position desired by the user.

The structure, installation, and operation of the control cage 118, the control cage adaptor 116, the gravity feed spout 124, and the control cage locking clamps 126 will be readily understood and recognized by those of ordinary skill in the art.

As illustrated in FIGS. 1-4, the forward face 104 of the rotatable throwing wheel 102 preferably comprises: a central recess 130; a forward peripheral portion 132 which surrounds the recess 130; and a plurality of slots 134 which are formed in the forward peripheral portion 132 for receiving blade holding structures 144. The recess 130, or at least a forward axial portion thereof, is hounded circumferentially by the axially extending interior wall 136 of the forward peripheral portion 132. The interior wall 136 extends rearwardly into the wheel face 104 from the circular inner edge 138 of the forward peripheral surface 146 and includes the blade insertion and removal openings 135 of the wheel/slot 134.

A circular groove 140 for removably holding the blade retainer 112 is provided in the face recess 130 proximate, most preferably directly adjacent to, the rearward axial end 142 of the interior sidewall 136. The cross-sectional shape of the circular groove 140 will correspond to the cross-sectional shape of the blade retainer 112. The circular groove 140 will most preferably have a semi-circular cross-sectional shape for receiving and removably retaining an O-ring element 112.

The present invention provides a very effective, yet much less costly and complex system for retaining the throwing blades 106 on the wheel face 104 during assembly and installation. After placing the projecting holding structures 144 of the blades 106 in the wheel slots 134 provided in the forward peripheral portion 132 of the wheel face 104, the blades are then conveniently retained in the wheel slots 134 by simply inserting an O-ring or other retaining element 112 in the circular groove 140. Likewise, the throwing blades 106 can be conveniently removed from the throwing wheel slots 134 by simply removing the retainer 112.

In order for the placement of an O-ring or other retainer 112 in the circular groove 140 to be effective for retaining the blade holding structures 144 in the wheel slots 134, the rearward axial depth of the wheel slots 134 is preferably such that the rearward ends of the blade holding structures 144 will come into contact with the retainer 112 and will thereby be blocked by the retainer 112 from leaving the inner ends of the slots 134. This convenient retaining ring arrangement would not be feasible if using a typical prior art single plate wheel. Moreover, if it were possible to install the throwing blades on the prior art single plate wheel, the retainer groove would itself block the removal of the blades, even after removing the retaining element therefrom.

In the inventive assembly 100, the use of the inventive retainer and groove arrangement is permitted and facilitated by one or a combination of additional inventive modifications to the rotating wheel 102. These improvements include: (a) sloping the forward surface 146 of the forward peripheral portion 132 of the wheel face 104 such that the forward surface 146 extends outwardly away from the recess 130 at a rearward angle 147 which is effective to allow the blade holding structures 144 to be delivered into and removed from the wheel slots 134 without interference from the circular groove 140; (b) forming the axially extending interior wall 136 of the forward peripheral portion 132 in a manner such that it converges rearwardly toward the axis of rotation 148 of the rotating wheel 102 at an angle 150; and/or (c) forming the wheel slots 134 such that they extend outwardly away from the recess 130 at a rearward angle 152 effective to allow the throwing blade holding structures 144 to be delivered into and removed from the wheel slots 134 without interference from the circular groove 140.

In the inventive assembly 100, a combination of these approaches is used such that the forward peripheral face surface 146, the interior wall 136, and the wheel slots 134 are all angled in the manner just described. In addition, the blade holding structures 144 are also configured such that, when installed, they will follow the orientation and angle of the wheel slots 134.

The rearward angle 147 of the forward peripheral face surface 146 of the rotating wheel will preferably be in the range of from about 4° to about 12° from a radial plane 154 perpendicular to the axis of rotation 148. The rearward angle 147 of the forward peripheral surface 146 will most preferably be about 8°. The rearward angle 152 of the blade retaining slots 134 will preferably be in the range of from about 4° to about 12° from the radial plane 154. The rearward angle 152 of the blade retaining slots 134 will most preferably be about 8°.

The interior wall 136 of the forward peripheral portion 132 will preferably be of a substantially conical shape such that the angle of rearward convergence 150 of the interior wall 136 toward the axis of rotation 148 of the rotating wheel 102 will be in the range of from about 2° to about 8°. The angle 150 of the interior wall 136 will most preferably be about 5°.

As illustrated in FIGS. 3-6, the wheel slots 134 and the blade holding structures 144 which are receivable therein preferably have corresponding dovetail shapes. However, it will be readily understood that other shapes and configurations could alternatively be used. In the dovetail configurations illustrated in FIGS. 3-6, the blade holding structures 144 each include at least one, preferably two, outwardly facing shoulders 156 which will engage one or more, preferably two, corresponding inwardly facing shoulders 158 provided in the wheel slots 134. The engagement of the blade shoulders 156 with the interior slot shoulders 158 prevents each of the throwing blade holding structures from being inserted beyond a predetermined insertion point and thus also ensures that the assembled components are properly balanced.

In addition to the modifications discussed above, the inventive throwing assembly 100 further comprises: a locking structure 170 which is formed on and projects rearwardly from the impeller 122; a correspondingly shaped locking slot 172 formed through the base 174 of the rotating wheel recess 130 for receiving the locking structure 170 such that the impeller 122 and the throwing wheel 102 will be caused to rotate together; a central aperture 176 formed through the rearward assembly hub 108 for receiving the driveshaft 178 of the throwing device; a longitudinal key slot 180 provided in the hub aperture 176 which mates with a corresponding longitudinal key 182 provided on the drive shaft 178 such that the hub is caused to rotate with the drive shaft; a plurality of drive pins 177 which extend forwardly from bores 179 formed in the hub 108 for engaging slots 181 in the rearward face of the throwing wheel 102 such that the throwing eel 102 and hub 108 are caused to rotate together; and a bore 184 extending through the rearward locking structure 170 of the impeller 122 such that the impeller 122 can be attached to the drive shaft by inserting a locking bolt 186 rearwardly through the bore 184 and then threading the locking bolt 186 into a threaded aperture 188 provided in the forward end of the drive shaft 178.

As will be understood by those in the art, alternative keying arrangements between the drive shaft 178 and the hub 108 could alternatively be used such as, for example, providing a key slot on the drive shaft 178 and a corresponding key in the hub aperture 176. It will also be understood that the drive shaft 178 can be directly driven by an electric motor or other device or can be indirectly driven using a belt, a gear, or any other driving system.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the invention as defined by the claims.

What is claimed is:

1. In an apparatus for throwing an abrasive material, said apparatus comprising a rotatable wheel and a plurality of throwing blades removably positionable on a forward face of said rotatable wheel, said rotatable wheel having an axis of rotation and each of said throwing blades having a holding structure projecting therefrom, the improvement comprising:

said forward face including a recess surrounded by a forward peripheral portion of said forward face such that at least a portion of said recess is bounded circumferentially by an axially extending interior wall of said forward peripheral portion;

a blade retainer groove provided in said recess of said forward face proximate a rearward end of said interior wall for removably receiving a blade retainer;

a plurality of slots extending through said interior wall and outwardly into said forward peripheral portion away from said recess for removably receiving said holding structures of said throwing blades; and said forward peripheral portion comprising a forward peripheral face surface which extends outwardly away from said recess at a rearward angle effective to allow said holding structures of said throwing blades to be delivered into and removed from said slots without interference from said blade retainer groove.

2. The apparatus of claim 1 wherein the improvement further comprises said rearward angle being in the range of from bout 4° to about 12° from a radial plane perpendicular to said axis of rotation.

3. The apparatus of claim 2 wherein the improvement further comprises said interior wall converging rearwardly toward said axis of rotation at an angle in the range of from about 2° to about 8°.

4. The apparatus of claim 1 wherein the improvement further comprises said rearward angle being about 8° from a radial plane perpendicular to said axis of rotation.

5. The apparatus of claim 4 wherein the improvement further comprises said interior wall converging rearwardly toward said axis of rotation at an angle of about 5°.

6. The apparatus of claim 1 wherein the improvement further comprises an O-ring which is receivable in said blade retainer groove for retaining said blade holding structures in said slots when assembling said apparatus.

7. The apparatus of claim 1 wherein the improvement further comprises said slots also extending outwardly away from said recess at a rearward angle effective to allow said holding structures of said throwing blades to be delivered into and removed from said slots without interference from said blade retainer groove.

8. The apparatus of claim 7 wherein the improvement further comprises said holding structures of said throwing blades being configured such that, when said holding structures are received in said slots, said holding structures will extend outwardly away from said recess at a rearward angle corresponding to said rearward angle of said slots.

9. The apparatus of claim 8 wherein the improvement further comprises said rearward angle of said slots being in the range of from about 4° to about 12° from a radial plane perpendicular to said axis of rotation.

10. The apparatus of claim 1 wherein the improvement further comprises said slots and said holding structures having corresponding dove-tail shapes.

11. The apparatus of claim 10 wherein the improvement further comprises said holding structures each including at least one shoulder and said slots each having at least one corresponding interior shoulder such that, when said holding structures are inserted into said slots, said shoulders of said holding structures will abut said interior shoulders to prevent said holding structures from being inserted beyond a predetermined insertion point.

12. In an apparatus for throwing an abrasive material, said apparatus comprising a rotatable wheel and a plurality of throwing blades removably positionable on a forward face of said rotatable wheel, said rotatable wheel having an axis of rotation and each of said blades having a holding structure projecting therefrom, the improvement comprising;

said forward face including a recess surrounded by a forward peripheral portion of said forward face such that at least a portion of said recess is bounded circumferentially by an interior wall of said forward peripheral portion;

a blade retainer groove provided in said recess of said forward face proximate a rearward end of said interior wall for removably receiving a blade retainer;

a plurality of slots extending through said interior wall and outwardly into said forward peripheral portion away from said recess for removably receiving said holding structures of said throwing blades; and said slots extending outwardly away from said recess at a rearward angle effective to allow said holding structures of said throwing blades to be delivered into and removed from said slots without interference from said blade retainer groove.

13. The apparatus of claim 12 wherein the improvement further comprises said holding structures of said throwing blades being configured such that, when said holding structures are received in said slots, said holding structures will extend outwardly away from said recess at a rearward angle corresponding to said rearward angle of said slots.

14. The apparatus of claim 13 wherein the improvement further comprises said rearward angle of said slots being in the range of from about 4° to about 12° from a radial plane perpendicular to said axis of rotation.

15. The apparatus of claim 14 wherein the improvement further comprises said slots and said holding structures having corresponding dove-tail shapes.

16. The apparatus of claim 12 wherein the improvement further comprises said holding structures each including at least one shoulder and said slots each having at least one corresponding interior shoulder such that, when said holding structures are inserted into said slots, said shoulders of said holding structures will abut said interior shoulders to prevent said holding structures from being inserted beyond a predetermined insertion point.

17. The apparatus of claim 12 wherein the improvement further comprises an O-ring which is receivable in said blade retainer groove for retaining said blade holding structures in said slots when assembling said apparatus.

* * * * *